US007080861B2

(12) United States Patent
Watanabe

(10) Patent No.: US 7,080,861 B2
(45) Date of Patent: Jul. 25, 2006

(54) ANTI-PANIC MECHANISM OF VEHICLE DOOR LATCH DEVICE

(75) Inventor: Hirofumi Watanabe, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/693,692

(22) Filed: Oct. 27, 2003

(65) Prior Publication Data

US 2004/0145191 A1 Jul. 29, 2004

(30) Foreign Application Priority Data

Oct. 25, 2002 (JP) ..... 2002-311935

(51) Int. Cl.
*E05C 3/16* (2006.01)

(52) U.S. Cl. ..... 292/216; 292/DIG. 23

(58) Field of Classification Search ..... 292/210, 292/216, DIG. 23, DIG. 26, 201, 336.3
See application file for complete search history.

(56) References Cited

U.S. PATENT DOCUMENTS 3,384,404 A * 5/1968 Slattery ..... 292/216
5,015,020 A * 5/1991 Mizuki ..... 292/216
5,046,341 A * 9/1991 Ogino et al. ..... 292/216
5,100,185 A * 3/1992 Menke et al. ..... 292/216
5,106,135 A * 4/1992 Menke et al. ..... 292/216
5,154,457 A * 10/1992 Watanabe ..... 292/216
5,181,754 A * 1/1993 Shibata ..... 292/216
5,188,406 A * 2/1993 Sterzenbach et al. ..... 292/216
5,653,484 A * 8/1997 Brackmann et al. ..... 292/216
5,803,515 A 9/1998 Arabia et al.
5,833,282 A * 11/1998 Ikeda ..... 292/216
6,126,212 A * 10/2000 Fujihara ..... 292/216
6,406,073 B1 * 6/2002 Watanabe ..... 292/216
6,629,711 B1 * 10/2003 Gleason et al. ..... 292/216
2004/0036298 A1 * 2/2004 Hayakawa et al. ..... 292/216

* cited by examiner

*Primary Examiner*—Brian E. Glessner
*Assistant Examiner*—Christopher Boswell
(74) *Attorney, Agent, or Firm*—Browdy and Neimark, PLLC

(57) ABSTRACT

An anti-panic mechanism for a vehicle door latch device comprises a movable member provided between to an open link and a lock lever, and an anti-panic spring elastically connecting the lock lever with the movable member. When an unlocking operation by an inside lock button is not completed normally due to a first opening operation of an open handle, the movable member is displaced by a spring force of the anti-panic spring to move the open link to an engageable position after the open lever is returned to an initial position. The movable member and lock lever are coaxially pivoted by a single common shaft.

1 Claim, 4 Drawing Sheets

ANTI-PANIC MECHANISM OF VEHICLE DOOR LATCH DEVICE

BACKGROUND OF THE INVENTION

1. Field of the Invention

The present invention relates to an anti-panic mechanism of vehicle door latch device.

2. Description of Related Art

In the conventional typical vehicle door latch device, the unlocking operation performed by using the inside lock button or the centralized door lock system or so forth is not completed normally, if the door open handle is subjected to the door opening operation, and the door cannot be opened. This state is often called a "panic state". In order to open the panicked door, it is necessary to return the open handle to a stand-by position (initial position) and to unlock the latch device with the lock button or the like again before the next opening operation of the door open handle is made to perform. Thus, when the door (latch device) falls into the panic state, the secondary unlocking operation and the secondary door opening operation are required.

The door latch device provided with the anti-panic mechanism reducing the complicated operation caused by the panic state is known (Japanese Utility Model Application Laid-Open No. SHO 58-101949, Japanese Patent Application Laid-Open No. HEI 11-324451). The prior art anti-panic mechanism is to exclude the second unlocking operation. Even if when the first unlocking operation is not completed normally due to the panic state caused by the early or simultaneously performed door opening operation, the anti-panic mechanism displaces the door latch device into unlocked state automatically after the open handle is returned to the stand-by position. Consequently, it is possible to open the door by the second door opening operation without the second unlocking operation.

The prior anti-panic mechanism is provided with a movable member urged by an anti-panic spring, and the movable member is pivotally mounted on the door latch device with a dedicated shaft, so that many parts are used.

SUMMARY OF THE INVENTION

An object of the present invention is to provide improved anti-panic mechanism which has a movable member pivotally mounted on a lock shaft which supports a lock lever rotatably. It is possible to decrease the number of parts of the device in such a way as to mount the movable member on the lock shaft. In addition, such a combination between the lock lever mounted on the lock shaft and the movable member has a size that is capable of being formed to be the approximately same size as the conventional lock lever. For that reason, it is possible to prevent an increase in size of the door latch device to the utmost. In addition, the movable member mounted on the lock shaft is turned together with the lock lever. For this means, it is easy for the movable member to obtain space where the movable member turns.

DESCRIPTION OF THE PREFERRED EMBODIMENT

Figure 1:
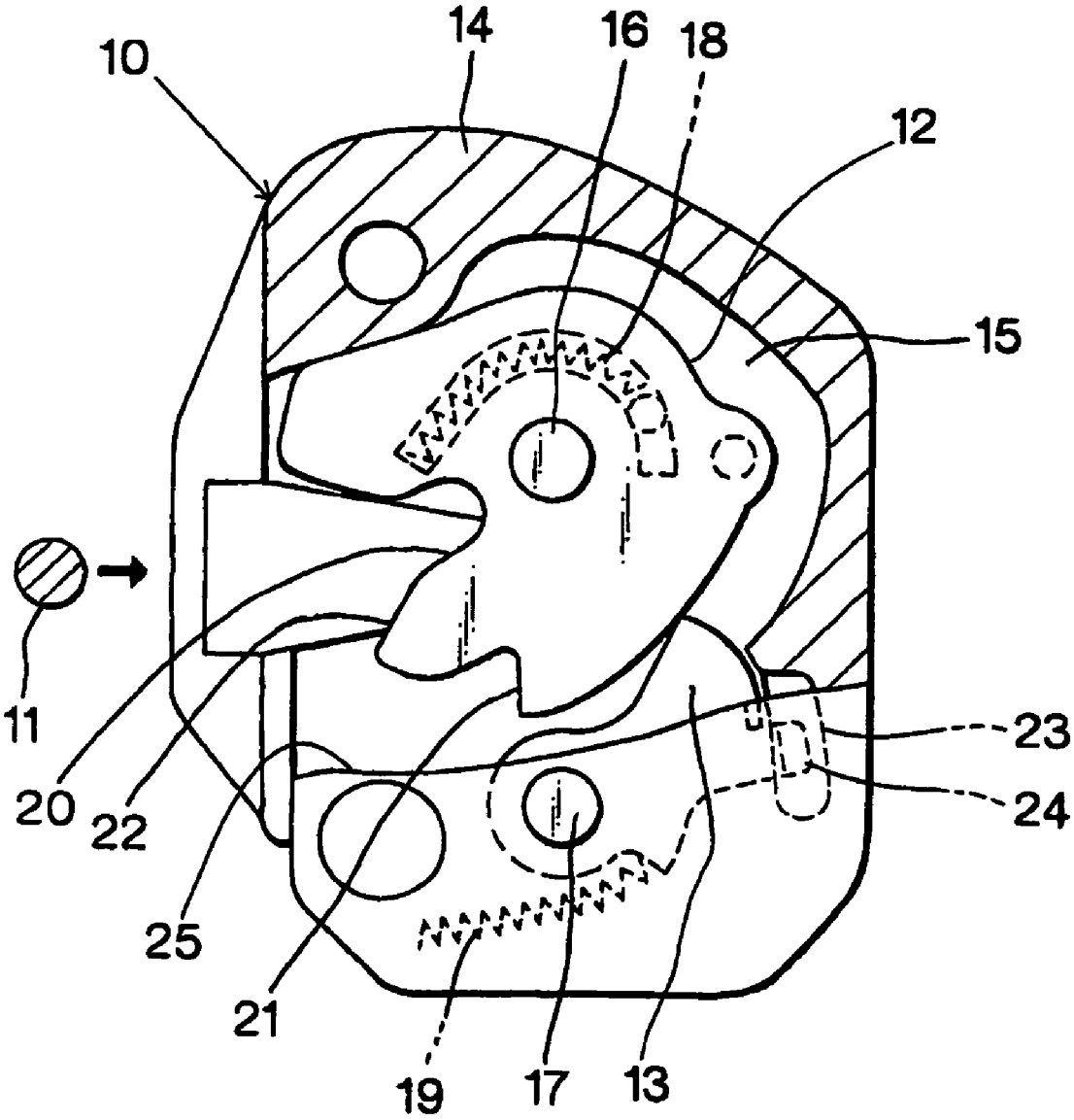
FIG. 1 is a front view of a door latch assembly of the present invention.

FIG. 1 shows the front of the door latch device according to the present invention. The door latch device has a latch assembly 10 mounted on a vehicle door (not shown) and a striker 11 fixed on the vehicle body (not shown). The latch assembly 10 has a latch 12 which is engaged with the striker 11 when the door is closed, and a ratchet 13 for maintaining engagement between the latch 12 and the striker 11. The latch 12 is rotatably contained within a recess 15 formed on the surface of a latch body 14 by means of a latch shaft 16 in a back-and-forth direction of the latch device, and the ratchet 13 is rotatably contained within the recess 15 by means of a ratchet shaft 17 in the back-and-forth direction.

The latch 12 is, in FIG. 1, urged in the clockwise direction by elasticity of a latch spring 18, and the ratchet 13 is urged in the counterclockwise direction by elasticity of a ratchet spring 19. The latch 12 as shown in FIG. 1 is located in unlatched position (door open position) by the elasticity of the latch spring 18. When the door is moved toward a door-closed position, the striker 11 comes into contact with a U-shaped groove 20 of the latch 12 to rotate the latch 12 counterclockwise. When the latch 12 is rotated up to a half-latched position, the ratchet 13 is engaged with a first step 21 of the latch 12 and the door reaches a half-closed position, and when the latch 12 comes to a full-latched position, the ratchet 13 is engaged with a second step 22 of the latch 12 and the door is maintained at a full-closed position.

The ratchet 13 has a ratchet pin 24 projecting to the rear side of the latch body 14 through an opening 23 of the latch body 14. To the front surface of the latch body 14, a metal cover plate 25 for covering the recess 15 is fixed. The cover plate 25 is shown partially in FIG. 1.

Figure 2:
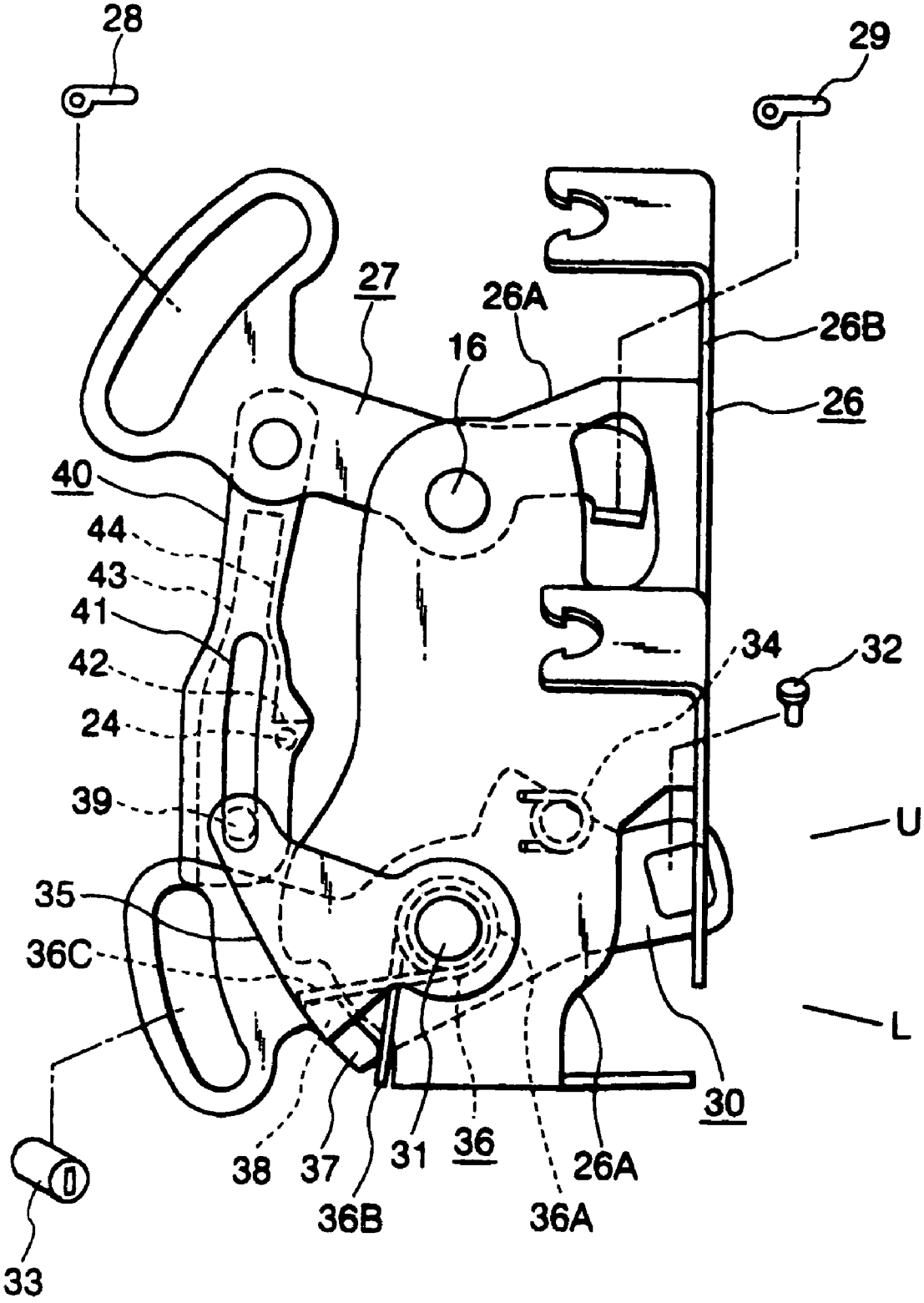
FIG. 2 is a rear elevation showing members provided at rear surface side of the door latch assembly.

A metal back plate 26 shown in FIG. 2 is fixed on a rear surface of the latch body 14. The back plate 26 is provided with a parallel plate 26A in approximately parallel with the cover plate 25. The latch body 14 is sandwiched between the cover plate 25 and the parallel plate 26A. The back plate 26 has a bent plate 26B which is angled to extend backward from the interior side edge of the parallel plate 26A.

Figure 5:
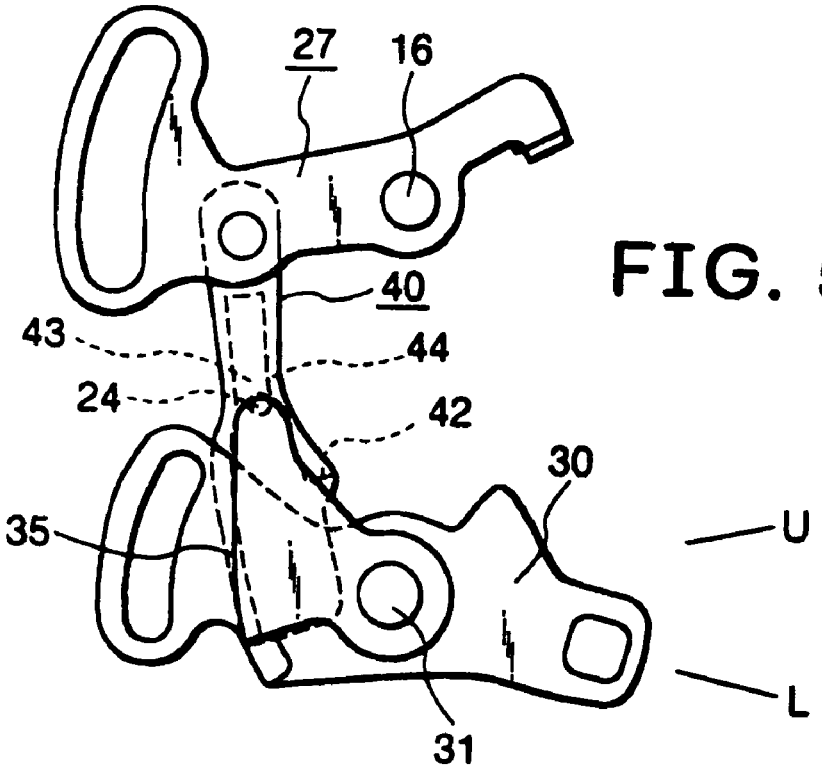
FIG. 5 is an arranging view showing a state in which the open lever is rotated in a door opening direction in the locked state.
Figure 6:
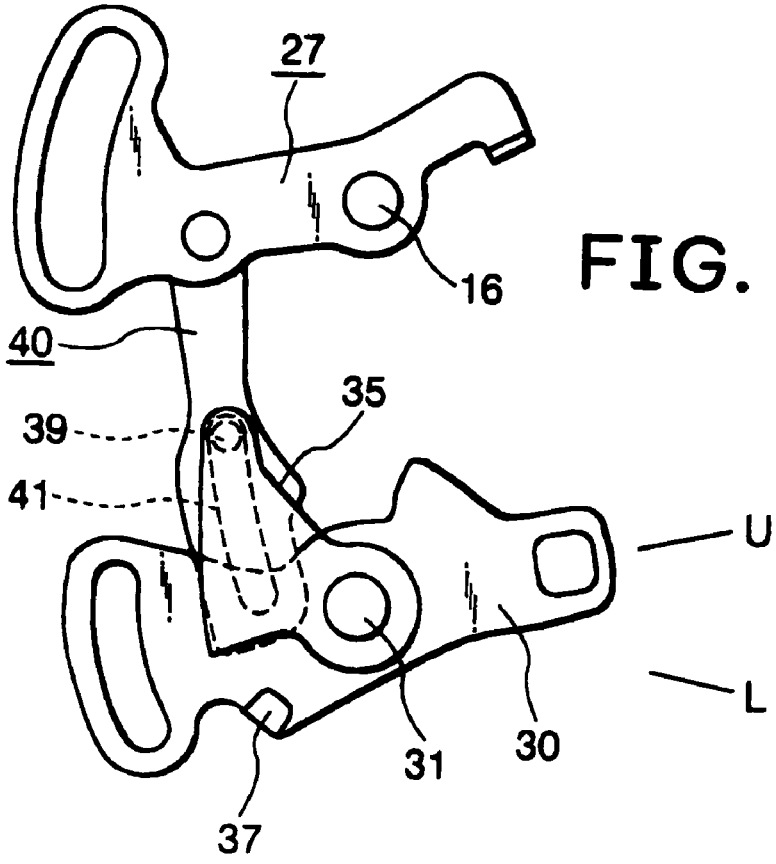
FIG. 6 is an arranging view showing a state in which the lock lever is displaced into unlocked position at the state of FIG. 5.

The latch assembly 10 has an open lever 27 for releasing the ratchet 13 from the latch 12 so as to open the door. The open lever 27 is pivotally mounted on the parallel plate 26A (latch body 14) by using the latch shaft 16 or by using another shaft. The open lever 27 is operatively coupled to an outside open handle 28 and an inside open handle 29 of the door, so that the open lever 27 is rotated counterclockwise in response to the door opening operation of the handles 28 and 29 to be displaced from the stand-by position (FIGS. 2 and 4) to an actuated position (FIGS. 5 and 6).

The latch assembly 10 further has a lock lever 30 which is pivotally mounted on the parallel plate 26A (latch body 14) by using a lock shaft 31. It is noted that the ratchet shaft 17 can be served as the lock shaft 31. The lock lever 30 is arranged between the parallel plate 26A and the latch body 14. The lock lever 30 is operatively coupled to an inside lock button 32 (and a door key cylinder 33, if necessary), and the lock lever 30 is held at one of a locked position L or an unlocked position U by an over center spring 34.

A movable member 35 for panic state measures is pivotally mounted on the lock shaft 31. A main body of the movable member 35 is arranged at rear side of the parallel plate 26A. An anti-panic spring 36 is arranged between the movable member 35 and the lock lever 30. A coil portion 36A of the spring 36 is arranged around the lock shaft 31. One leg part 36B of the spring 36 is brought into contact with a projecting part 37 of the lock lever 30 which is projected to rearward beyond the parallel plate 26A. The other leg part 36C of the spring 36 is brought into contact with a projecting part 38 of the movable member 35. The movable member 35 is urged in the unlocking (counterclockwise) direction due to spring force of the spring 36, and is maintained in the state where the member 35 comes into contact with the projecting part 37 of the lock lever 30. Generally, the movable member 35 is rotated integrally with the lock lever 30.

The movable member 35 is provided integrally with a forwardly projecting pin part 39 which is slidably engaged with a rearward guide slot 41 of an open link 40. An upper part of the open link 40 is pivotally coupled to the open lever 27. When the movable member 35 is displaced to the unlocked position (FIGS. 2 and 3) together with the lock lever 30, the open link 40 shifts to left side engageable position, and when the movable member 35 is displaced to the locked position (FIGS. 4 and 5) together with the lock lever 30, the open link 40 shifts to right side non-engageable position.

A contact portion 42 is provided at the front surface of the open link 40. The contact portion 42, when the open link 40 is placed at the engageable position (FIGS. 2 and 3), is arranged in facing relationship with the ratchet pin 24 and engageable with the ratchet pin 24 in the up-and-down direction. Thus, when the open link 40 moves downward due to rotation of the open lever 27, the contact portion 42 comes into contact with the ratchet pin 24 and moves it downward, thereby the ratchet 13 is released from the latch 12 and the door is opened. When the open link 40 is displaced to the non-engageable position (FIG. 4), the contact portion 42 is alienated from the ratchet pin 24, thereby the downward movement of the open link 40 cannot open the door as shown in FIG. 5.

A passageway 43 for the ratchet pin 24 is formed at front side of the open link 40. When the open link 40 moves downward while the open link 40 is located at the non-engageable position, the ratchet pin 24 relatively moves upward within the passageway 43. A right side wall 44 of the passageway 43 functions as an anti-unlock wall. The wall 44 restricts the movement of the open link 40 (lock lever 30) toward the engageable position (unlocked position) by the engagement with the ratchet pin 24 when the ratchet pin 24 is situated within the passageway 43.

OPERATION

Figure 3:
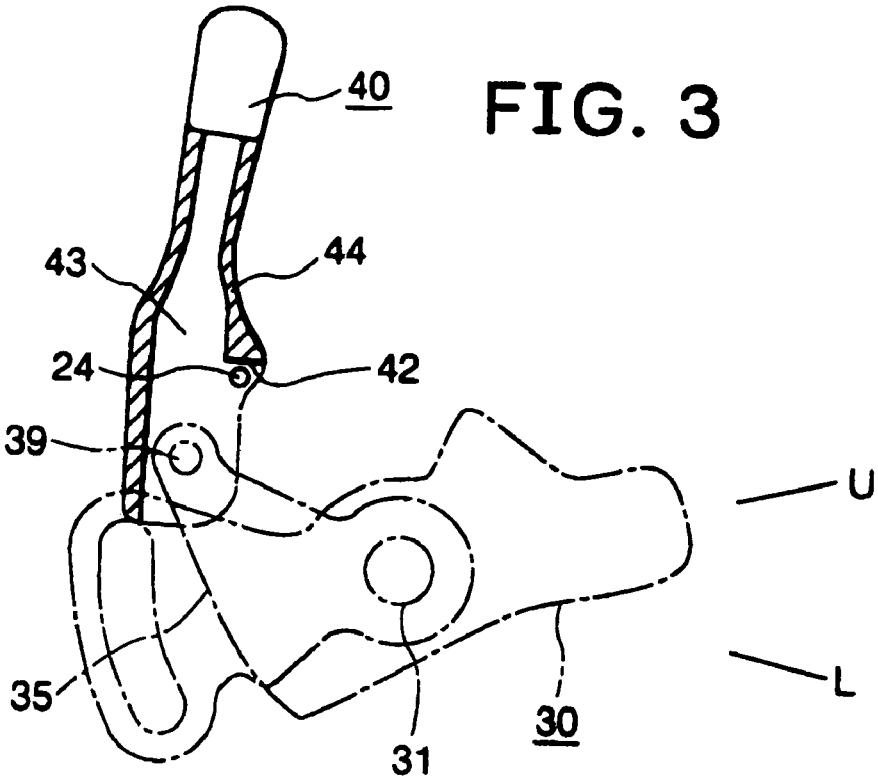
FIG. 3 is a cross-sectional view showing a contact surface of an open link and a passageway of the latch assembly.
Figure 4:
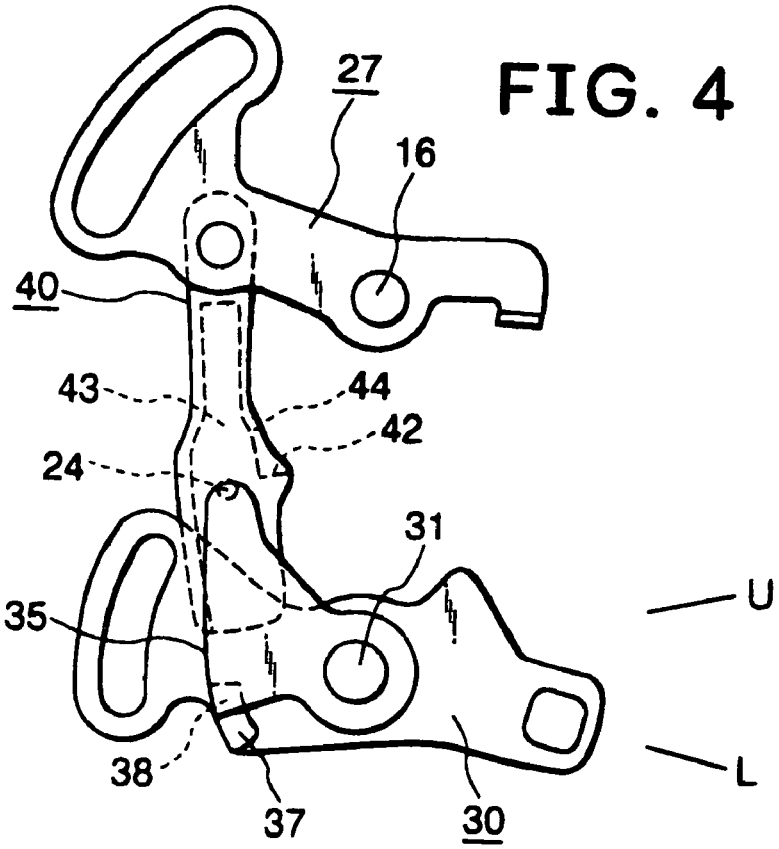
FIG. 4 is an arranging view of respective members in the locked state.

In the unlocked state of FIGS. 2 and 3, when the locking operation of the inside lock button 32 or the like is performed, the lock lever 30 is rotated clockwise to move to the locked position L exceeding the dead point of the over center spring 34, and the movable member 35 also moves to the locked position, the open link 40 then moves rightward to be displaced to the non-engageable position, thereby the latch device becomes the locked state as shown FIG. 4.

In the locked state of FIG. 4, when performing the door opening operation of the outside or inside open handles 28, 29, the open lever 27 is rotated counterclockwise as shown in FIG. 5, and the open link 40 moves downward. However, in the locked state, the contact portion 42 of the open link 40 cannot come into contact with the ratchet pin 24, therefore, the ratchet pin 24 does not move downward, consequently the door is not opened.

In the state of FIG. 5 where the open lever 27 is in the actuated position by the door opening operation of the outer side open handle 28 or the inner side open handle 29, when unlocking operation of the inside lock button 32 and so forth is performed, the lock lever 30 is displaced to the unlocked position U independently as shown in FIG. 6 while leaving the movable member 35 at the locked position.

Namely, as shown in FIG. 5, when the open link 40 moves downward in the non-engageable state, the ratchet pin 24 relatively enters into the passageway 43 of the open link 40, and the ratchet pin 24 then stands face to face with the wall 44 of the open link 40, thereby the displacement of the open link 40 toward the engageable position is restricted. In addition, the movable member 35 of which the pin part 39 is engaged with a guide slot 41 of the open link 40 cannot be also displaced into the unlocked position. For this reason, when the unlocking operation of the inside lock button 32 and so forth is performed in the state of FIG. 5, the lock lever 30 is, as shown in FIG. 6, displaced to the unlocked position U independently while being widened the anti-panic spring 36, and the movable member 35 is left in the locked position. Thereafter the lock lever 30 is held at the unlocked position U due to elasticity of the over center spring 34 as shown in FIG. 6.

In the state of FIG. 6, when the open lever 27 is released from the door opening operation of the outside open handle 28 or the inside open handle 29 to return to the initial position, the open link 40 moves upward, and the ratchet pin 24 is then got out the passageway 43 (the wall 44) of the open link 40, thereby the restriction of the open link 40 and the movable member 35 toward the unlocked position is released. Therefore, the open link 40 and the movable member 35 can be displaced to the unlocked position due to elasticity of the anti-panic spring 36. Consequently, it is possible to change the latch device into the unlocked state without performing the secondary unlocking operation by the inside lock button 32 and so forth.

As described above, in the present invention, the movable member 35 which is urged by the anti-panic spring 36 is pivotally mounted on the lock shaft 31 for the lock lever 30. By this means, it is not necessary to prepare the dedicated member for supporting the movable member 35. In addition, the lock lever 30 is changed between the locked position and the unlocked position by rotating about the lock shaft 31 as the center, therefore, a space where the lock lever 30 is arranged is suitable for accommodating the rotationable member, that is, movable member 35. Further, owing to the lock lever 30 and movable member 35 are coaxially pivoted the lock shaft 31, they are formed in the approximately same size as the conventional lock lever. For that reason, it is possible to prevent an increase in size of the door latch device to the utmost.

What is claimed is:

1. An anti-panic mechanism for a vehicle door latch device comprising:

an open lever displaceable from an initial position to an actuated position in response to a door opening operation of an outside open handle of a door;

a lock lever for connection to an inside lock button of the door and displaceable between a locked position and an unlocked position;

an open link displaceable between an engageable position in which a displacement of the open lever toward the actuated position is transmitted to a ratchet pin of a ratchet when the lock lever is in the unlocked position and a non-engageable position in which the displacement of the open lever toward the actuated position is not transmitted to the ratchet pin when the lock lever Is in the locked position;

a movable member provided between the open link and the lock lever so as to transmit the displacement of the lock lever to the open link:

an anti-panic spring elastically connecting the lock lever with the movable member;

wherein when the lock lever is displaced from the locked position into the unlocked position while the open lever is being in the actuated position by a first opening operation of the open handle, the lock lever is changed to the unlocked position against the spring force of the anti-panic spring without moving the movable member;

wherein when the open lever is returned to the initial position after the first opening operation of the open handle, the movable member is displaced by the spring force of the antipanic spring to move the open link to the engageable position;

wherein each of said movable member and said lock lever are both coaxially pivoted on a same single common shaft; and wherein the anti-panic spring is engaged on said same single common shaft between said lock member and said movable member.

* * * * *